US005263605A

United States Patent [19]

Caton

[11] Patent Number: 5,263,605

[45] Date of Patent: Nov. 23, 1993

[54] SEPARATOR FOR BOTTLE PACKAGING

[75] Inventor: André Caton, Loriol, France

[73] Assignee: PLV Concepts, Valence, France

[21] Appl. No.: 863,290

[22] PCT Filed: Oct. 26, 1990

[86] PCT No.: PCT/FR90/00773

§ 371 Date: Jun. 26, 1992

§ 102(e) Date: Jun. 26, 1992

[87] PCT Pub. No.: WO91/06487

PCT Pub. Date: May 16, 1991

[30] Foreign Application Priority Data

Oct. 26, 1989 [FR] France ..... 89 14336

[51] Int. Cl.[5] ..... B65D 21/02

[52] U.S. Cl. ..... 220/519; 220/514; 206/203; 206/427; 206/821; 206/504

[58] Field of Search ..... 206/203, 427, 821, 503, 206/504, 508, 509, 511, 518, 519, 520; 220/519, 518, 517, 516, 514, 512, 509

[56] References Cited

U.S. PATENT DOCUMENTS

| | | | |
|---|---|---|---|
| 3,416,694 | 12/1968 | Bebb | 220/518 |
| 3,771,646 | 11/1973 | Mascetti, Jr. | 206/519 |
| 4,037,722 | 7/1977 | Bremer | 206/203 |
| 4,567,981 | 2/1986 | Heddon | 206/821 |
| 4,773,554 | 9/1988 | Warwick | 206/509 |
| 4,848,573 | 7/1989 | Salacuse | 206/821 |
| 5,178,276 | 1/1993 | Sheets | 206/503 |

FOREIGN PATENT DOCUMENTS

| | | | |
|---|---|---|---|
| 1351218 | 12/1963 | France | 220/514 |
| 2240326 | 7/1991 | United Kingdom | 206/821 |
| 9200885 | 1/1992 | World Int. Prop. O. | 220/519 |

*Primary Examiner*—Allan N. Shoap
*Assistant Examiner*—S. Castellano
*Attorney, Agent, or Firm*—Bacon & Thomas

[57] ABSTRACT

The invention concerns a separator, of the type comprising a sheet provided with openings for centering the necks (3) of a layer of bottles (8) and protrusions (5) extending from the upper face of the sheet to center the bottoms (4) of a superposed layer of bottles, characterized in that each opening is defined, on the one hand, by at least two projections 12 presented by the sheet to abut on the shoulder (23) of the bottle and, on the other hand, by a cap 11 whose height is adapted to shroud the neck (3) of the bottle, when the projections (12) abut on the shoulder of the bottle.

16 Claims, 9 Drawing Sheets

SEPARATOR FOR BOTTLE PACKAGING

TECHNICAL DOMAIN

The present invention relates to the packaging of empty or full bottles in superposed layers and more particularly to the packaging of bottles having to be stored, transported or presented at sales points in the form of palletized loads from the place of manufacture up to a marketing point, via a bottling point and/or a surface treatment point.

The method of storage and packaging bottles, in the form of palettizable loads, consists in placing on a pallet a first tray on which are placed bottles forming a stable layer covered by an intermediate tray (separator) adapted to allow the constitution of a superposed layer, and so on.

The problems to be solved for constituting a palletizable load giving complete satisfaction are of several orders.

Firstly, it is important to be able to constitute each layer of bottles so as to form a stable foundation, adapted to support the superposed layer. Each separator in question must therefore be able to perform a first function of centering the necks of the lower layer of bottles and a function of centering the bottoms of the bottles of the superposed layer.

Another function of each separator is to maintain the bottles so that they undergo little or no friction against one another, in order to eliminate the risks of scratchings, cracks or breaks during transports or handlings.

Another function of the separators is to be able to perform the two functions mentioned above despite the random shapes of the bottles which, due to their very material and process of manufacture, present admissible or tolerable deformations.

PRIOR TECHNIQUE

In an attempt to solve the overall problem set forth hereinabove, the prior art has proposed a first type of separator consisting in having the bottom of the bottles of a superposed row supported by the rings of the necks of the (underneath) row of bottles. This first type of separator is very frequently used for delivering empty glassware.

Such a separator is composed of a sheet of cardboard possibly associated with a plastic coating. Such separators present the drawback of being sensitive to humidity, which renders them tearable after a short or medium period of time.

The state of the art has also proposed, according to Patents FR 2 450 453 and FR 2 530 226, separators made of thermoformed plastics material. In practice, it appears that these separators present the drawback of retaining the condensation water formed along the heat-shrinkable cover which envelops the pallet. This results in the clean bottles being soiled.

Along the same lines, it must be ascertained that, for the different types of separators described hereinabove, the separator wears at the level of the points of friction between the upper part of the neck of a bottle and the bottom of the superposed bottle, with the result that particles detach from the separator and soil the clean bottles. Moreover, the number of layers of pallettizable bottles on the same pallet is limited to about 2 meters high. Stacking also remains limited to three superposed pallets.

Furthermore, such separators are difficult to re-use for storing the finished products, and for producing supports for sale, due to the deformations that they have undergone during the different handlings.

The state of the art knows a second type of separator generally used for transporting and storing full glassware. This second type of separator comprises a superposed layer of bottles, each placed in quincunx with respect to the lower layer of bottles, so that the necks of one layer of bottles are arranged between the bottoms of the superposed layer of bottles.

To make such a type of separator, the prior art has proposed using a sheet of cardboard provided with holes for receiving the necks of the bottles. Such a separator presents the drawback of lacking rigidity, of conserving the deformations undergone during transport and of being sensitive to humidity. This results in a deterioration of the covering and of the bottle.

The state of the art has also proposed, by publications FR 1 347 005, FR 1 443 932 and FR 2 625 475, separators made of plastics material which present a good support for storing the bottles. However, it appears necessary to have available a range of separators adapted as a function of each bottle, which involves employing a large, expensive stock. Moreover, the bottles undergo frictions against one another, capable of causing deteriorations of the covering of the bottles, even breakage thereof. Furthermore, such separators are in no way adapted to take into account the manufacturing tolerances of the bottles.

STATEMENT OF THE INVENTION

The present invention aims at overcoming the various drawbacks set forth hereinabove by proposing a separator designed to be used for storing and transporting empty or full bottles, and for presenting full bottles at the marketing points.

The object of the invention also aims at proposing a separator adapted to eliminate the friction of the bottles against one another and to establish a pseudotightness of the open necks, in order to avoid pollution thereof.

The object of the invention also aims at offering a separator adapted to perform a function of centering the necks of the lower layer of bottles and a function of centering the bottoms of the bottles of the superposed layer, despite the manufacturing tolerances of the bottles.

The object of the invention also aims at proposing a separator adapted to constitute pallets of height greater than those of the prior art, without requiring envelopment by a heat-shrinkable cover.

The object of the invention further aims at offering a separator adapted for bottles with long or short necks.

To attain the different objects set forth hereinabove, the separator, for packaging superposed bottles, is of the type comprising a sheet provided with openings intended for centering the necks of a lower layer of bottles and protrusions adapted to cooperate with the bottoms of a superposed layer of bottles.

According to the invention, the separator is characterized in that each centering opening is defined, on the one hand, by at least two projections presented by the sheet in order to abut on the shoulder of the bottle and, on the other hand, by a cap portion whose height is adapted to shroud the neck of the bottle, when the projections abut on the bottle shoulder.

Various other characteristics will appear from the following description with reference to the accompanying drawings which show, by way of non-limiting examples, embodiments of the object of the invention.

BEST MANNER OF IMPLEMENTING THE INVENTION

Figure 1:
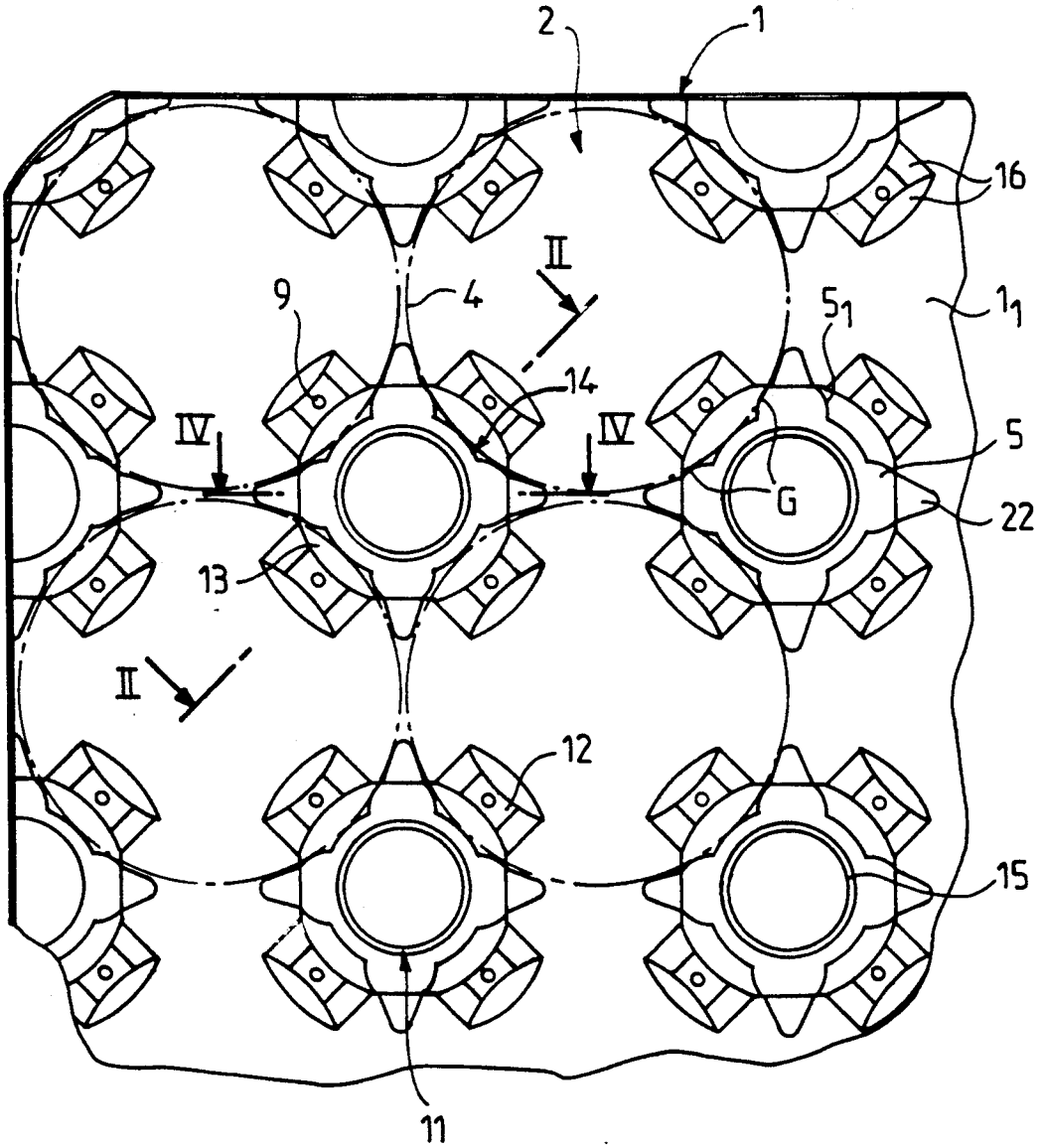
FIG. 1 is a plan view of a variant embodiment of a separator according to the invention, adapted for bottles with long neck. along lines II—II of FIG. 1.
Figure 2:
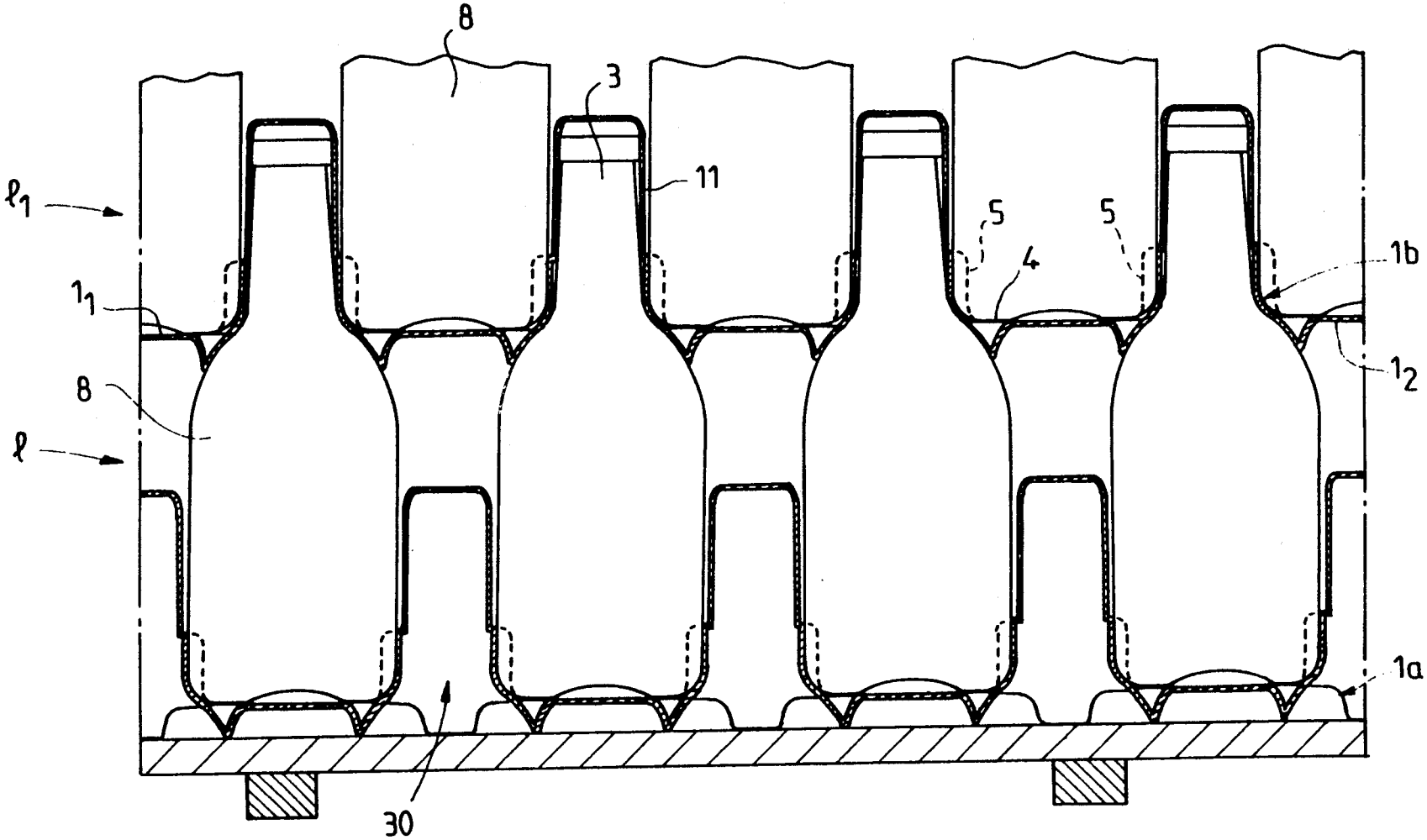
Figure 3:
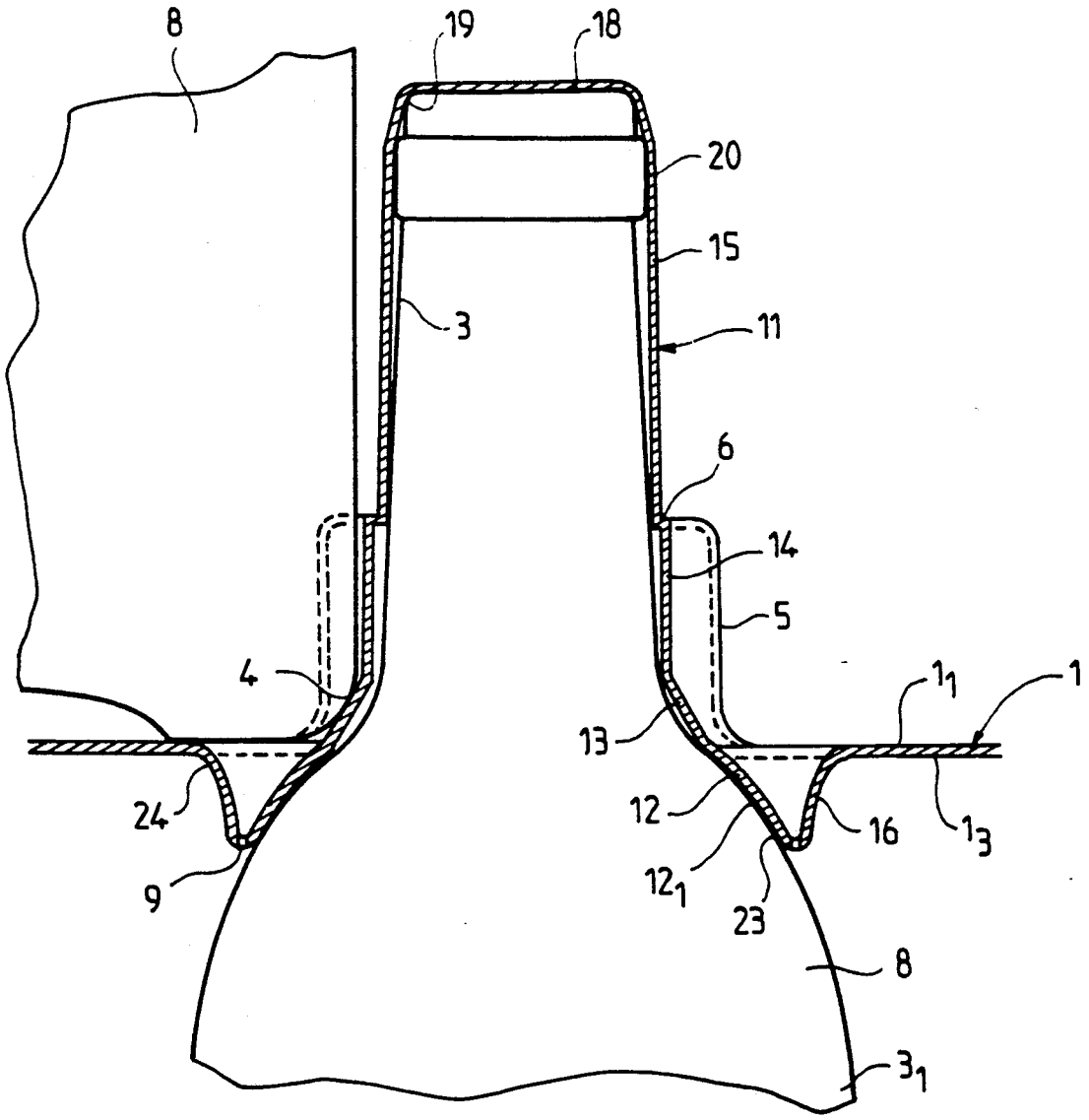
FIG. 3 is a view, similar to FIG. 2, showing, on a larger scale, the separator according to the invention.

FIGS. 1 to 3 illustrate a separator 1 according to the invention, constituted by a sheet presenting an upper face 11 and a lower face 12 The sheet is constituted from a material of any type known per se, such as polystyrene, polyethylene, ABS, polycarbonate, taken individually or mixed. In known manner, the sheet 1 is provided with a series of openings 30 each adapted to ensure centering of the necks 3 of a layer 1 of bottles 8. The sheet is also provided with protrusions 5 extending from the upper face $1_1$ the sheet to ensure centering of the bottoms 4 of bottles 8 of a superposed layer $1_1$.

In the embodiment illustrated in FIGS. 1 and 2, the openings are disposed in a regular grid arrangement so as to define, four by four, a square whose centre is common with the axis of symmetry of the bottle of the superposed layer. Such a disposition therefore makes it possible to obtain a quincunx arrangement of the bottles.

According to the invention, each opening of the sheet is defined by at least two, and in the example illustrated, by four supports, bosses, bearing surfaces or projections 12, adapted or presented by the sheet to abut on the shoulder 23 of the bottle, defined between the neck 3 and the body $3_1$ of the bottle. In the example illustrated, the projections 12 extend from the lower face $1_2$ of the sheet. Each opening is also provided, according to the invention, with a cap 11 presenting dimensions adapted to shroud the neck 3 of the bottle when the projections 12 abut on the shoulder of the bottle. The height of the cap 11 is therefore adapted to shroud the neck of the bottle, whilst enabling the projections 12 to abut on the shoulder, as is shown more precisely in FIG. 3. The caps 11 and the projections 12 are preferably, but not exclusively, made by thermoforming.

In the embodiment illustrated in FIGS. 1 to 3, each cap 11 extends in projection with respect to the upper face $1_1$ of the sheet. Each cap is constituted by a closed cone 15 extended by a guiding sleeve 14 which is joined to a conical element 13 defining the opening 30 and facilitating introduction of the neck of the bottle inside the cap. Each conical element 13 is extended by a projection 12 presenting rigid walls. To that end, according to a preferred embodiment, each projection 12 is made by a shaping or hollow impression presenting a general prismatic shape whose angles are rounded. Each projection 12 presents a contact wall $12_1$ whose general profile is substantially complementary with that presented by the shoulder 23 of the bottle, so as to follow as best possible the shape thereof. Each wall $12_1$ which is extended by a conical element 13 is connected to the sheet by a rigid rib 16 of incurved shape with rounded radius of connection 24, in order to rigidify the projection.

As shown more precisely in FIG. 3, each projection 12 comprises a ventilation hole 9 ensuring passage of a fluid between the two faces of the sheet. The holes 9 are made in the lower part of the projections 12 so as to avoid stagnation of the condensation.

Figure 4:
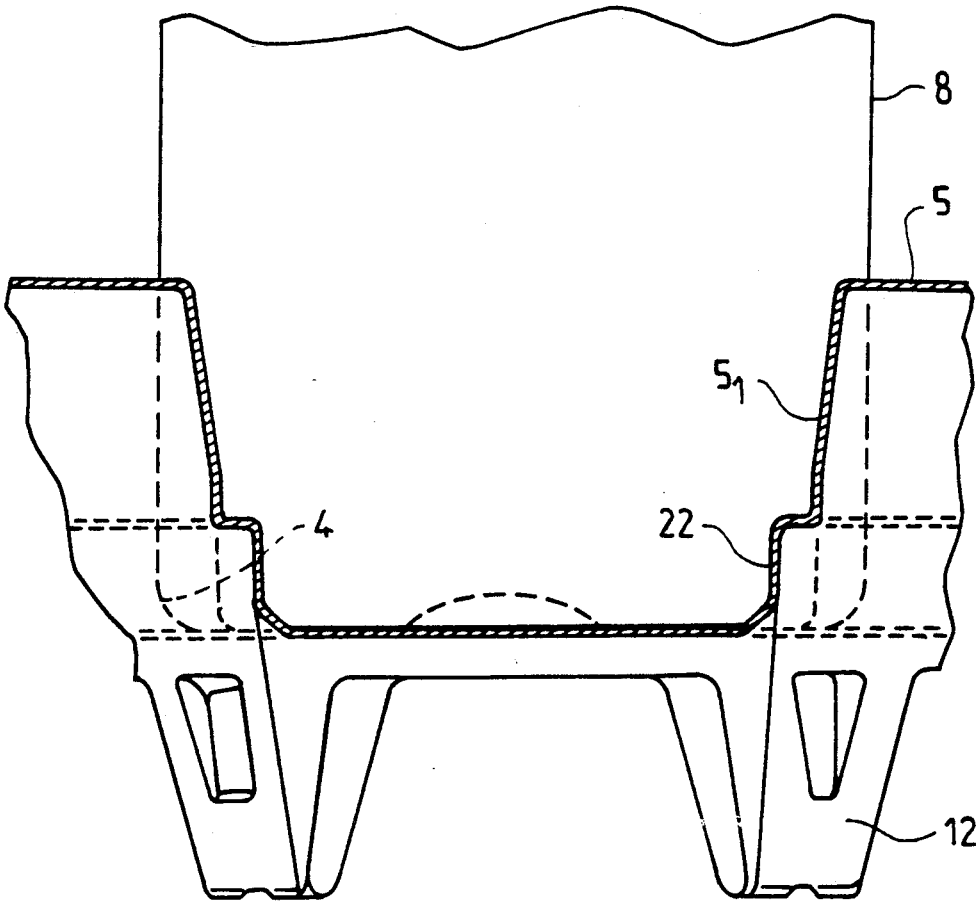
FIG. 4 is a view in section taken substantially along lines IV—IV of FIG. 1, to show a characteristic detail of the invention.

As shown more precisely in FIGS. 1 and 4, the sheet is provided with protrusions 5 extending outwardly, from each sleeve 14, in a number equal to four for example, each being placed between two consecutive projections 12. According to the invention, the protrusions 5 present supple vertical walls $5_1$ or which are crushably deformable and located at the vertical of the points of tangency of the bottom 4 of a bottle. As appears more precisely in FIG. 1, the bottom 4 of a bottle is therefore guided to come into contact or abutment on a generatrix G of this crushably deformable wall, so as to compensate the differences of manufacturing tolerance of the bottle. These protrusions 5 present incurved shapes, with rounded radius of connection and are connected to the sheet by rigid ribs 22. Of course, this rigid rib 22 may extend to connect, or not, two protrusions 5 disposed opposite, so as to ensure a determined distance between two adjacent bottles.

The sleeve 14 preferably also presents supple or crushably deformable walls, on which the bottle is capable of abutting, with the result that the sleeves also contribute to the take-up of the differences in manufacturing tolerance. In the example illustrated, the bottom 4 of the bottle, shown in dashed and dotted lines in FIG. 1, is therefore centred via four sleeves 14 and eight protrusions 5 which may be considered as being located at the vertical of the points of tangency of the bottom of a bottle and thus defining an impression 2 for receiving the bottom of a bottle. The bottle 8 is capable of being in contact with these different points giving it a considerable stability.

To produce a palletized load, for example of empty bottles, the latter should be introduced into the bottom impressions 2 of a base sheet 1*a*, thus constituting a first layer 1. A separator 1*b* is then placed in position by introducing the different necks 3 of the bottles of the layer 1 inside the caps 11 of this separator. The bottles of the upper layer $1_1$ are then positioned in the complementary impressions so that the weight of such a superposed layer of bottles causes the abutment or stop of the projections on the shoulders of the bottles of the lower layer.

According to an advantageous embodiment illustrated in FIG. 3, each cap 11 may be provided to present a height substantially equal to that of the neck 3 of the bottle, with the result that the cap, which presents a longitudinal elasticity, undergoes a longitudinal elastic deformation to ensure both a contact of the cap 11 with the outside of the edge 19 of the bottle and an abutment of the projections 12 on the shoulder 23 of the bottle. The whole of the pressure is limited by the projections with rigid walls which abut on the shoulder of the bottle, thus immobilizing the separator on the lower layer of bottles.

According to this variant, the cap 11 also abuts on the ring 20 presented by the bottle. In this way, the cap hermetically obturates the opening 18 of the neck, preventing any soiling of the internal volume of the bottle. Moreover, the neck 3 of the bottle is entirely protected by the cap 12, avoiding friction of the bottles on one another and making it possible to eliminate the risks of scratches, cracks or breaks during transports and manipulations. Such a pallet thus produced offers a considerable stability due to the presence of the projections 12 ensuring a fixed hold of the bottles. Moreover, the protrusions 5, by their position and production, ensure individual hold of the bottoms 4 of the bottles.

The separator according to the invention therefore allows packaging of bottles, empty or full, having to be stored, transported or presented at a sales point. For this latter use, it may be provided to make, for example at the level of the guiding sleeve between the latter and the cone 15, a shoulder 6 in which incipient cracks are made to facilitate detachment of the cap 11 from the separator, so as to allow visualization of the necks of the bottles of the lower layer when the separator is still in place.

Of course, it may be provided that the cap 11 and/or the projections 12 are added, in isolated manner or in a single piece, on a sheet 1 via any suitable means, such as by welding, gluing, clipping, etc . . .

It must also be considered that the walls $12_1$ of the projections, in contact with the bottle, may be coated with a coating of supple nature or nonaggressive for the glass or covering of the bottle, so as to leave this covering and/or the glass intact.

Figure 5:
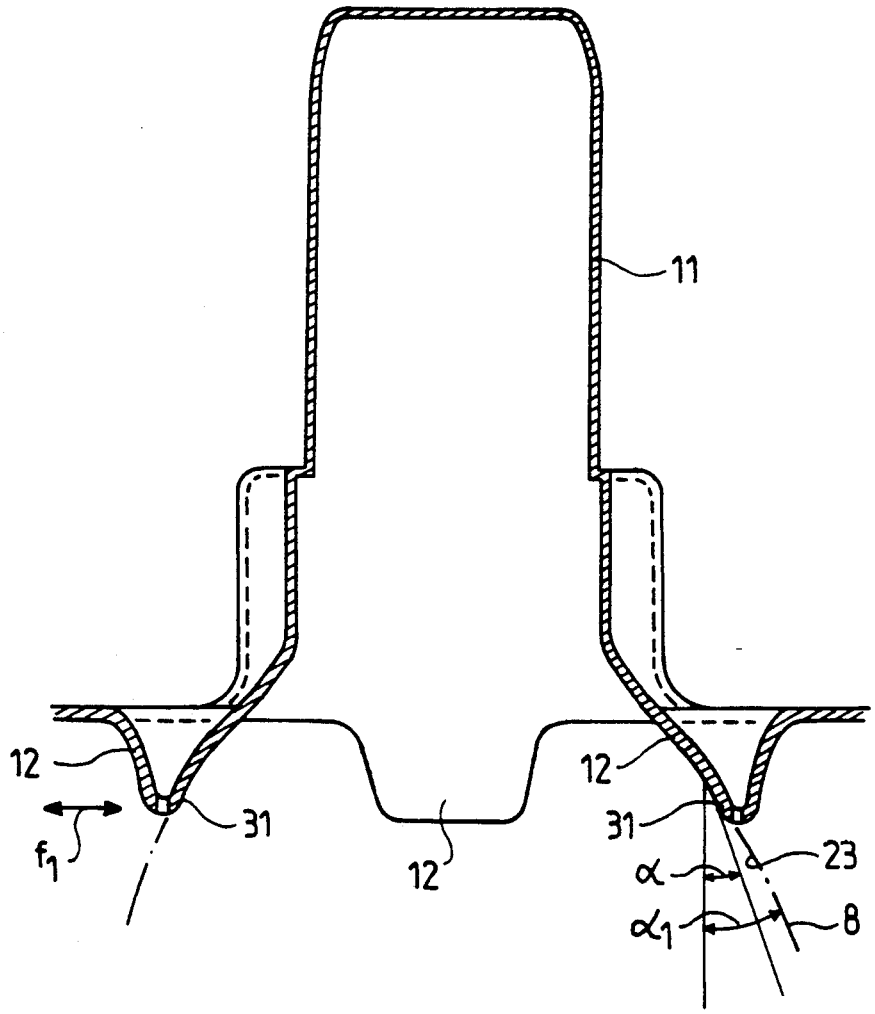
FIG. 5 is a view, similar to FIG. 3, showing a characteristic detail of the invention.

To avoid a mechanical jamming between the projections and the bottles, each projection 12 is advantageously extended, as illustrated by FIG. 5, by an anti-jamming part 31, deformable radially in the direction of arrows $f_1$ and presenting, in the rest state, a relief angle $\alpha$ less than the angle $\alpha_1$ presented by the shoulder 23 of the bottle shown in broken lines. As appears more precisely on comparing FIGS. 3 and 5, this anti-jamming part 31 is therefore radially deformed outwardly to come into contact with the shoulder of the bottle, under the effect of the weight of the superposed layer of bottles. During withdrawal of the bottles of the superposed layer, this part 31 exerts an opposite radial effort, in the direction of the bottle, ensuring a separation of the projections 12 from the wall of the bottles, bringing about a slight but sufficient rise of the sheet allowing an easy removal of the sheet.

Figure 6:
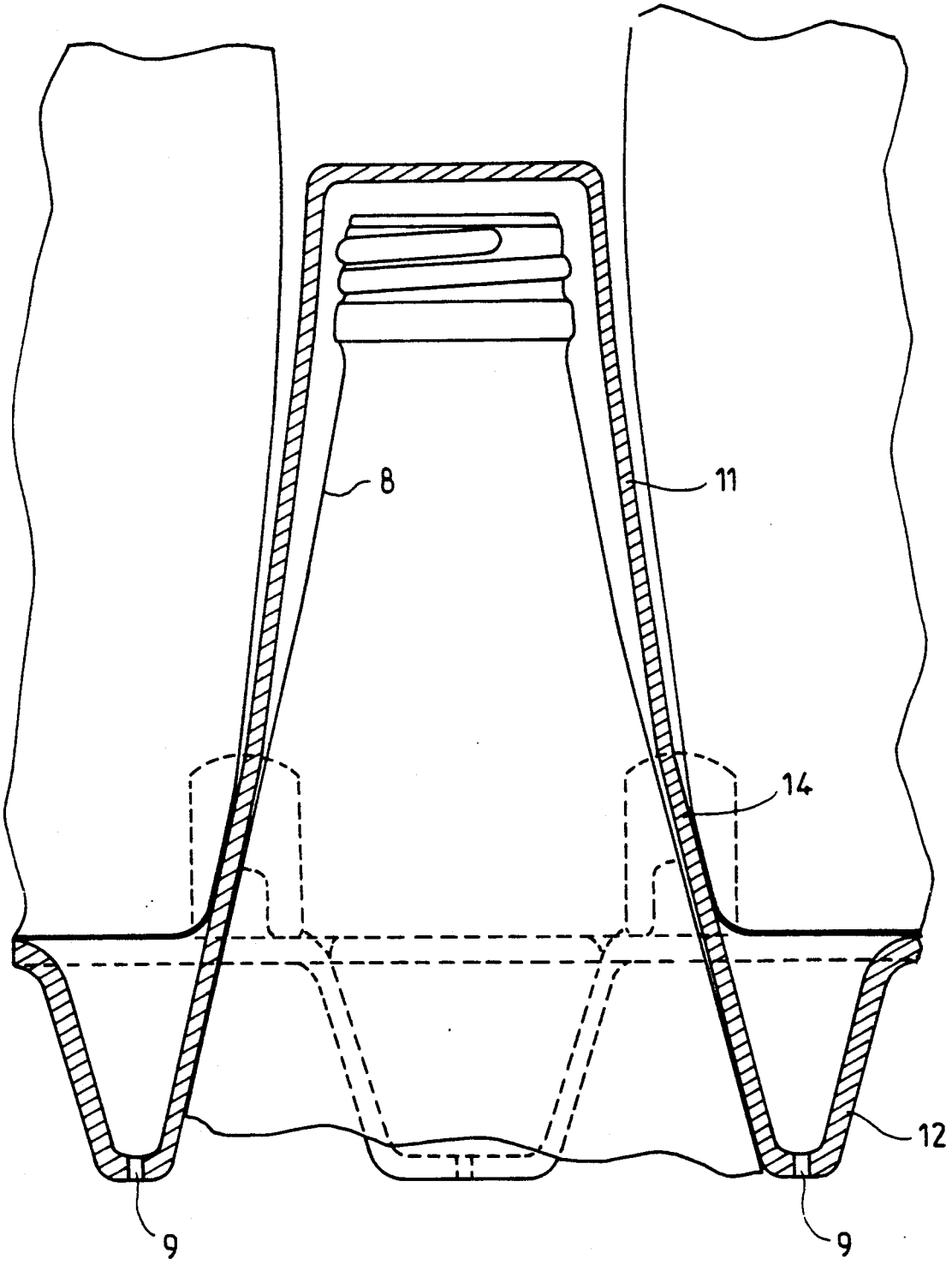
FIGS. 6 and 7 are views, similar to FIG. 3, showing another variant embodiment of the invention.
Figure 7:
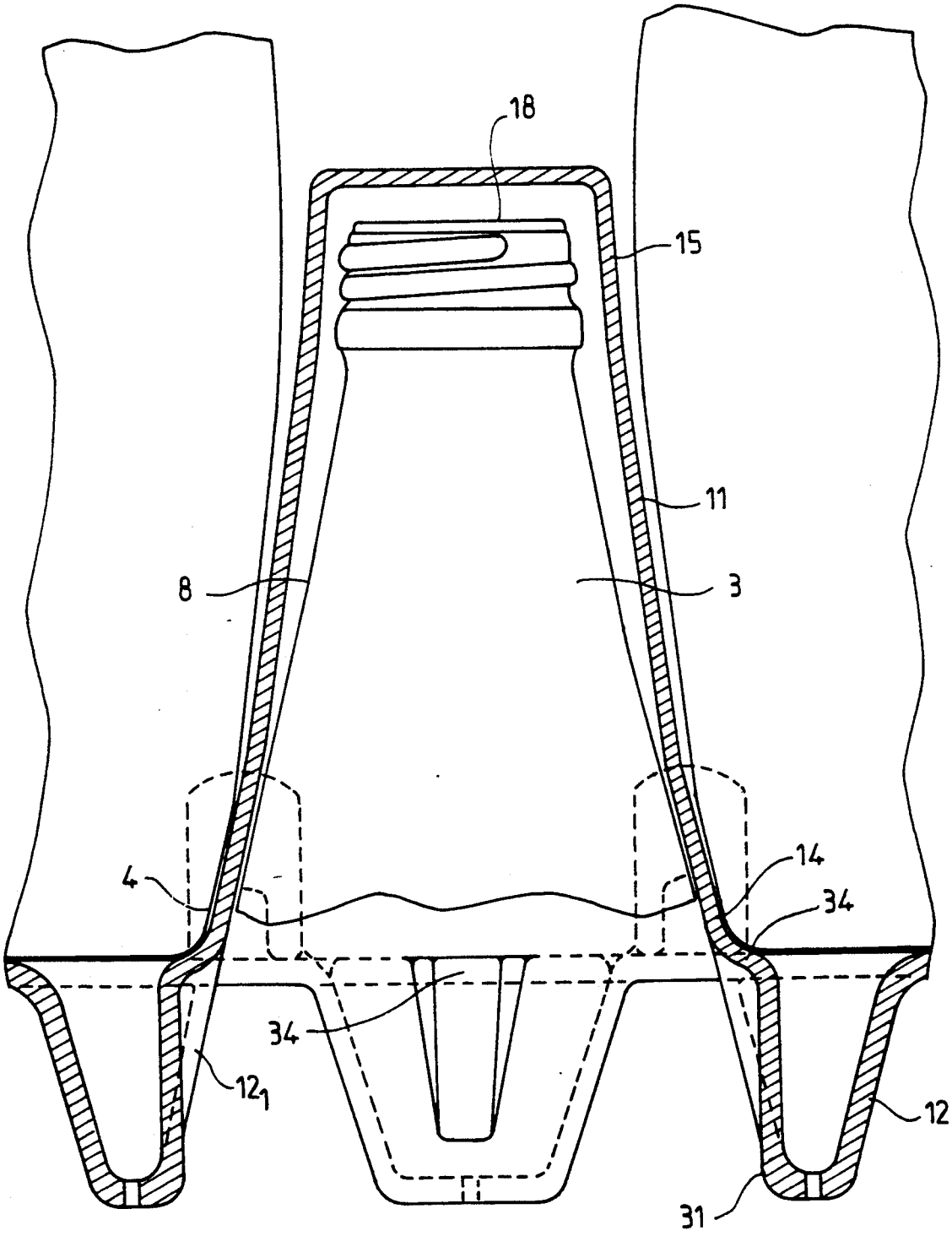

FIGS. 6 and 7 illustrate another variant embodiment of a separator differs from the FIG. 1-3 embodiment in that the caps 11 present a height greater than the neck 3 of a bottle. In this way, when the projections 12 are in abutment or stop on the shoulder 23 of a bottle, the closed cone 15 extends, by its base, to a distance from the opening 18 of the neck 3. Such a separator may thus be used for empty bottles and full bottles on which stoppers have been placed. It should be noted that this type of separator also avoids soiling of the internal volume of the bottle, insofar as the guiding sleeve 14 ensures tightness, by its cooperation with the shoulder of the bottle.

As shown in FIG. 7, each sleeve 14 is provided, level with the projections 12, with a raised edge for abutment 34 extending at the level of the sheet and increasing the bearing surface of the bottom 4 of a bottle. This raised edge 34 may be formed by a hollow shaping made locally in a part of the wall $12_1$ of the projection.

Figure 8:
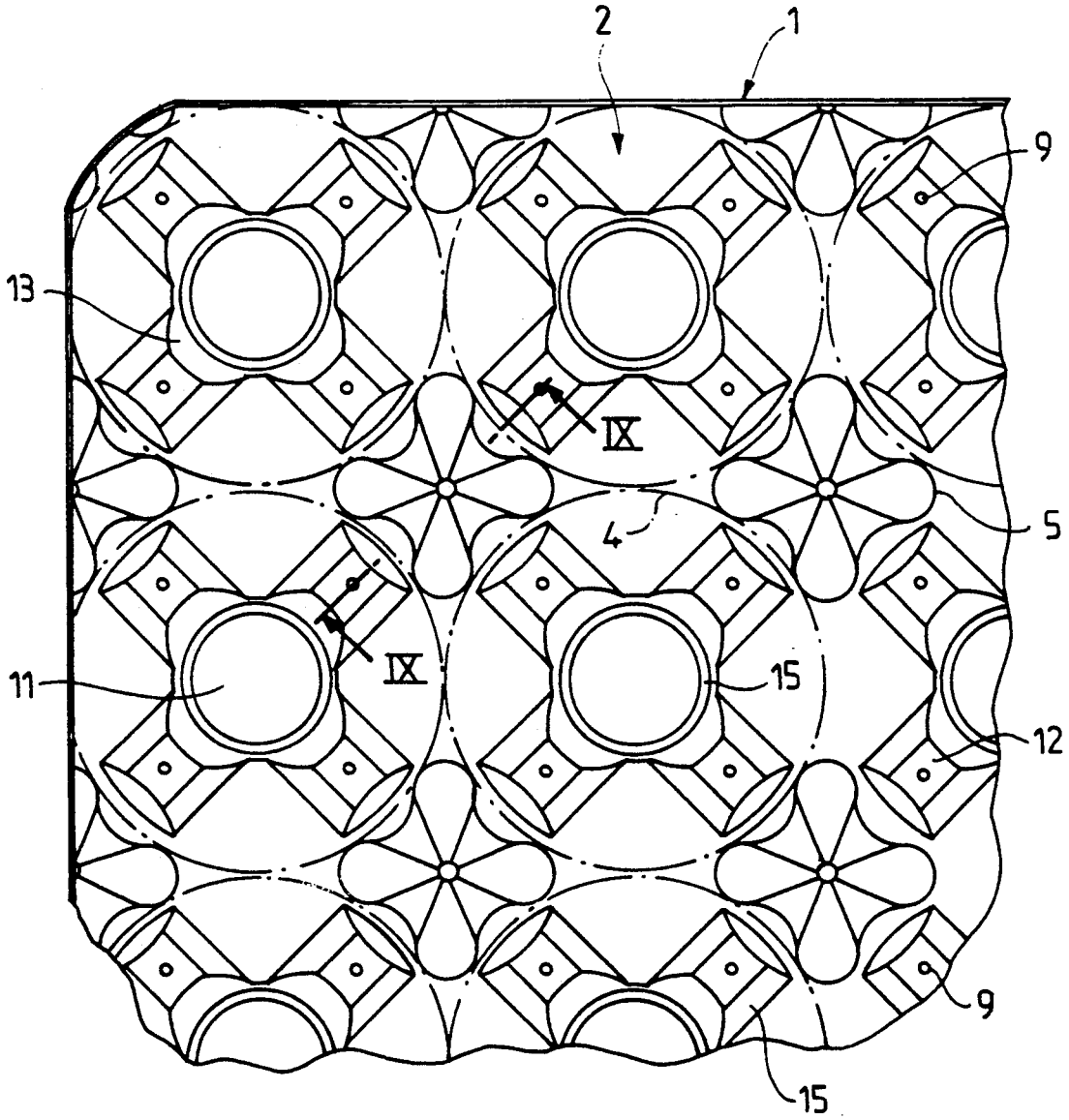
FIG. 8 is a plan view from above showing another variant embodiment of a separator according to the invention adapted to bottles with short neck.
Figure 9:
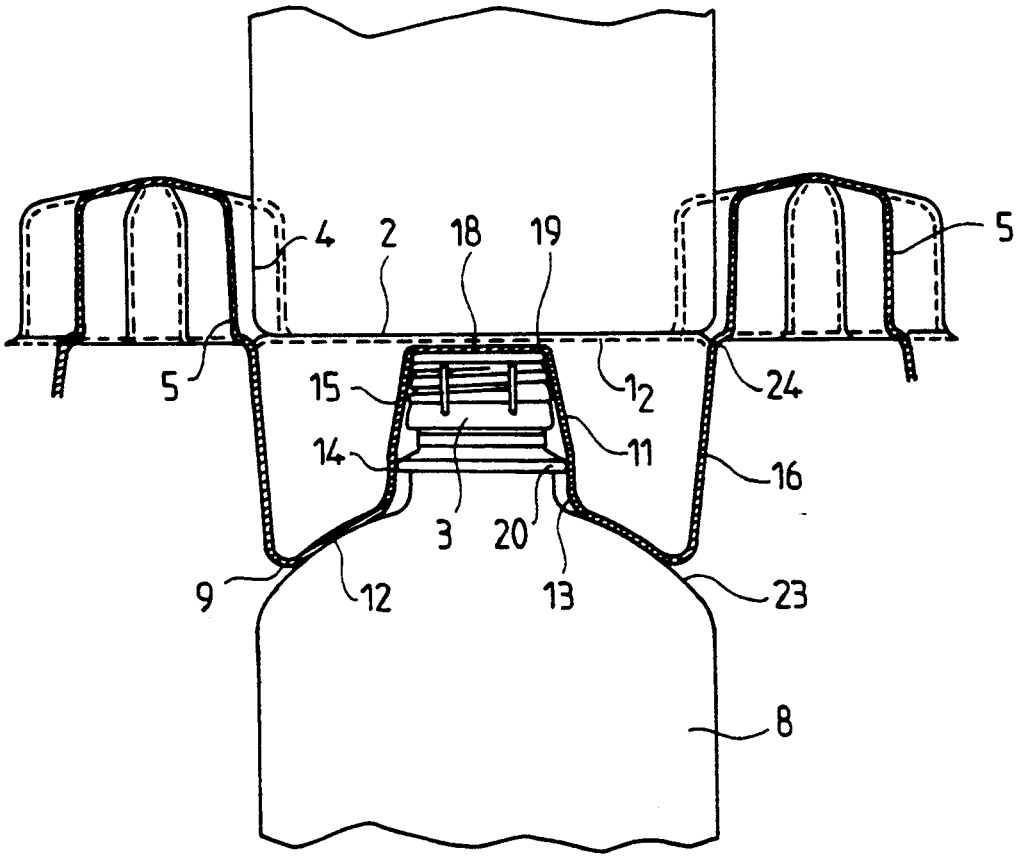
FIG. 9 is a view in section taken substantially along lines IX—IX of FIG. 8.

FIGS. 8 and 9 illustrate a variant embodiment of a separator according to the invention, particularly adapted for bottles with short or virtually non-existent necks. According to this variant embodiment, each cap 11 extends in recess with respect to the plane of the sheet 1, so that the closed cone 15 of the cap extends in a plane distant from the lower face $1_2$. This sheet also comprises the projections 5, whose characteristics and shapes are identical to those defined hereinabove. Such a variant makes it possible to place the bottles of two adjacent layers in superposed manner, so that the general axis of a bottle merges substantially with the general axis of a cap 11. The protrusions 5 also present supple or crushably deformable walls and are disposed in a regular grid arrangement, so as to define four by four a square whose centre is common with the general axis of a cap. Such protrusions therefore ensure reception, blockage and centering of a bottom of a bottle which does not come into contact with the cap placed opposite.

POSSIBILITY OF INDUSTRIAL APPLICATION

The invention finds a particularly advantageous application for the packaging of bottles, empty or full, having to be stored, transported or presented at a marketing point.

The invention is not limited to the examples described and shown, as various modifications may be made thereto without departing from its scope.

I claim:

1. Separator for packaging bottles in superposed layers, the bottles having a bottom, a body, and a neck, a shoulder for connecting the body to the neck and the neck has an outside edge, of the type comprising a sheet provided with openings (30) for centering the necks (3) of a lower layer of bottles (8) and protrusions (5) extending from the upper face of the sheet to center the bottoms (4) of a superposed layer of bottles, characterized in that each centering opening (30) is defined, on the one hand, by at least two projections (12) presented by the sheet to abut on the shoulder (23) of a bottle in the lower layer and, on the other hand, by a cap (11) whose height is adapted to shroud the neck (3) of the bottle, when the projections (12) abut on the shoulder of the bottle.

2. Separator according to claim 1, characterized in that each cap (11) presents a height substantially equal to that of the neck (3) of the bottle and presents a longitudinal elasticity, with the result that the cap (11) undergoes a longitudinal elastic deformation to ensure both a contact of the cap with the outside of the edge (19) of the bottle and an abutment of the projections (12) on the shoulder of the bottle.

3. Separator according to claim 1, characterized in that each projection (12) is extended by an antijamming part (31) radially deformable and presenting a relief angle ($\alpha$) less than that ($\alpha_1$) of the shoulder (23) of the bottle, so that this part is radially deformed in order to come into contact with the shoulder, under the effect of the superposed layer of bottles, and exerts an opposite radial effort, upon withdrawal of the superposed layer of bottles, in order to ensure separation of the projections from the shoulders of the bottles of the lower layer.

4. Separator according to claim 1 or 3, characterized in that each projection (12) is provided with an aeration hole (9) opening out on either side of the sheet.

5. Separator according to claim 1 or 3, characterized in that each projection (12) is formed by an impression made in the sheet.

6. Separator according to claim 1 or 2, characterized in that each cap (11) comprises a closed cone (15) extended by a guiding sleeve (14) connected to conical elements (13) extending the projections (12).

7. Separator according to claim 6, characterized in that each cap (11) comprises, at the level of the, guiding sleeve (14), incipient cracks allowing the cap to be detached from the separator.

8. Separator according to claim 1, characterized in that the caps (11) and the projections (12) are added to the sheet.

9. Separator according to claim 1, characterized in that the caps (11) and the projections (12) are formed from the sheet.

10. Separator according to claim 1, characterized in that the caps (11) extend in projection with respect to the upper face of the sheet and are disposed in a regular grid arrangement, so as to define, four axis of symmetry of a bottle of the superposed layer.

11. Separator according to claim 1, characterized in that the caps (11) are recessed with respect to the plane of the sheet and present a general axis substantially merged with that of symmetry of a bottle of the superposed layer.

12. Separator according to claim 1 or 11, characterized in that the protrusions (5) present crushably deformable walls and are disposed in a regular grid arrangement, so as to define, four by four, a housing (2) for the bottom (4) of a bottle of the superposed layer.

13. Separator according to claim 1, characterized in that a sleeve (14) is defined by crushably deformable protrusions (5) located at the vertical of the points of tangency of the bottom of a bottle, in order to constitute points of contact with the bottle, giving it a stability.

14. Separator according to claim 6, characterized in that each sleeve (14) is provided, level with the impressions, with a raised edge for abutment (34) extending in the plane of the sheet, in order to increase the bearing surface of the bottom of a bottle of the superposed layer.

15. Separator according to claim 1 or 11, characterized in that the caps (11) define, four by four, a square whose centre is common to the axis of a protrusion (5) presenting crushably deformable walls.

16. Separator according to claim 13, characterized in that each sleeve (14) is provided, level with the impressions, with a raised edge for abutment (34) extending in the plane of the sheet, in order to increase the bearing surface of the bottom of the bottle of the superposed layer.

* * * * *